US012638211B2

(12) United States Patent
Al-sulaimani

(10) Patent No.: US 12,638,211 B2
(45) Date of Patent: May 26, 2026

(54) LOCKING PROTECTIVE VENT GRILL COVER FOR BABY PROOFING

(71) Applicant: Musa Al-sulaimani, Port Matilda, PA (US)

(72) Inventor: Musa Al-sulaimani, Port Matilda, PA (US)

( * ) Notice: Subject to any disclaimer, the term of this patent is extended or adjusted under 35 U.S.C. 154(b) by 354 days.

(21) Appl. No.: 18/222,240

(22) Filed: Jul. 14, 2023

(65) Prior Publication Data

US 2023/0375213 A1 Nov. 23, 2023

Related U.S. Application Data

(63) Continuation-in-part of application No. 29/868,600, filed on Dec. 8, 2022, now Pat. No. Des. 1,073,915.

(60) Provisional application No. 63/364,811, filed on May 17, 2022.

(51) Int. Cl.
*F24F 13/08* (2006.01)

(52) U.S. Cl.
CPC ..... *F24F 13/082* (2013.01)

(58) Field of Classification Search
CPC ..... F24F 13/082; F24F 13/084
See application file for complete search history.

(56) References Cited

U.S. PATENT DOCUMENTS

| | | | | |
|---|---|---|---|---|
| 5,720,660 | A * | 2/1998 | Benedetto | F24F 13/08 454/289 |
| 2009/0162596 | A1* | 6/2009 | Rios | A63B 60/14 428/141 |
| 2019/0262738 | A1* | 8/2019 | Hyslop | A63H 33/105 |

* cited by examiner

*Primary Examiner* — Allen R. B. Schult
(74) *Attorney, Agent, or Firm* — Jonathan D'Silva; Benjamin Clarke; Penn State Dickinson Law IP Clinic

(57) ABSTRACT

A protector for an HVAC vent cover comprises a top surface that covers the top face of the HVAC vent cover. The top surface has an underside. A side wall extends downwards from the perimeter of the underside of the protector a distance at least equivalent to the thickness of the HVAC vent cover. A lip extends inward from the bottom of the side wall along the underside of the top surface.

20 Claims, 10 Drawing Sheets

LOCKING PROTECTIVE VENT GRILL COVER FOR BABY PROOFING

CROSS-REFERENCE TO RELATED APPLICATIONS

This Patent Application claims priority to U.S. Provisional Patent Application Ser. No. 63/364,811 filed May 17, 2022, titled "Protective Vent Grill Cover For Baby Proofing and Uses Thereof". This Patent Application is a continuation-in-part of, and claims priority benefit of U.S. Design patent application Ser. No. 29/868,600, filed Dec. 8, 2022, titled "Babyproof Vent Cover". All of the aforementioned disclosures are hereby incorporated by reference herein in their entireties including all references cited therein.

FIELD OF TECHNOLOGY

Embodiments of the present disclosure are directed to a locking, protective vent grill cover system, and more particularly, a locking, protective vent grill cover system for baby proofing.

SUMMARY

In some embodiments, the systems described herein relate to a locking, protective vent grill cover system including: a protective top cover configured to provide cushioning against external impact including a top cover rectangular perimeter, the top cover rectangular perimeter including: a front rectangular perimeter; a back rectangular perimeter; a left side rectangular perimeter; and a right side rectangular perimeter; an underside opposite of the protective top cover configured to lock to a vent grill; a front opposing end wall extending below the front rectangular perimeter of the top cover rectangular perimeter, the front opposing end wall including: a front interior surface of the front opposing end wall; and a front exterior surface of the front opposing end wall; a back opposing end wall extending below the back rectangular perimeter of the top cover rectangular perimeter and opposing the front opposing end wall, the back opposing end wall including: a back interior surface of the back opposing end wall; and a back exterior surface of the back opposing end wall; a left opposing side wall extending below the left side rectangular perimeter of the top cover rectangular perimeter, the left opposing side wall including: a left interior surface of the left opposing side wall; and a left exterior surface of the left opposing side wall; a right opposing side wall extending below the right side rectangular perimeter of the top cover rectangular perimeter and opposing the left opposing side wall, the right opposing side wall including: a right interior surface of the right opposing side wall; and a right exterior surface of the right opposing side wall; and a locking system, including; a releasable locking lip, including: a front releasable locking lip extending inward from the front interior surface of the front opposing end wall; a back releasable locking lip extending inward from the back interior surface of the back opposing end wall; a left releasable locking lip extending inward from the left interior surface of the left opposing side wall; and a right releasable locking lip extending inward from the right interior surface of the right opposing side wall; the releasable locking lip being aligned with a perimeter of the vent grill when the locking, protective vent grill cover system is in a locked position covering the vent grill, the locked position including: the front releasable locking lip engaging and covering a front edge perimeter of the vent grill; the back releasable locking lip engaging and covering a back edge perimeter of the vent grill; the left releasable locking lip engaging and covering a left edge perimeter of the vent grill; and the right releasable locking lip engaging and covering a right edge perimeter of the vent grill.

In some embodiments, the systems described herein relate to a locking, protective vent grill cover system, wherein the protective top cover further includes apertures, the apertures being through the protective top cover and the underside allowing for airflow through a duct connected to the vent grill.

In some embodiments, the systems described herein relate to a locking, protective vent grill cover system, wherein the apertures are a hexagonal shape.

In some embodiments, the systems described herein relate to a locking, protective vent grill cover system, wherein the apertures include slits, the slits being aligned with vent slits of the vent grill allowing for airflow through the duct connected to the vent grill.

In some embodiments, the systems described herein relate to a locking, protective vent grill cover system, wherein the apertures include circular holes, the circular holes having a diameter less that any opening on the vent grill thereby reducing airflow through the duct connected to the vent grill.

In some embodiments, the systems described herein relate to a locking, protective vent grill cover system, wherein the protective top cover is solid with no apertures inhibiting airflow through a duct connected to the vent grill.

In some embodiments, the systems described herein relate to a locking, protective vent grill cover system, wherein the releasable locking lip extends a distance equal to a thickness of the protective top cover including: the front releasable locking lip extending inward from the front interior surface of the front opposing end wall the distance equal to the thickness of the protective top cover; the back releasable locking lip extending inward from the back interior surface of the back opposing end wall the distance equal to the thickness of the protective top cover; the left releasable locking lip extending inward from the left interior surface of the left opposing side wall the distance equal to the thickness of the protective top cover; and the right releasable locking lip extending inward from the right interior surface of the right opposing side wall the distance equal to the thickness of the protective top cover.

In some embodiments, the systems described herein relate to a locking, protective vent grill cover system, wherein the releasable locking lip extends a distance greater than a thickness of the protective top cover including: the front releasable locking lip extending inward from the front interior surface of the front opposing end wall the distance greater than the thickness of the protective top cover; the back releasable locking lip extending inward from the back interior surface of the back opposing end wall the distance greater than the thickness of the protective top cover; the left releasable locking lip extending inward from the left interior surface of the left opposing side wall the distance greater than the thickness of the protective top cover; and the right releasable locking lip extending inward from the right interior surface of the right opposing side wall the distance greater than the thickness of the protective top cover.

In some embodiments, the systems described herein relate to a locking, protective vent grill cover system, wherein the releasable locking lip extends a distance greater than an aperture distance, the aperture distance being a shortest distance of apertures in the protective top cover to the top cover rectangular perimeter including: the front releasable locking lip extending inward from the front interior surface of the front opposing end wall the distance greater than the aperture distance; the back releasable locking lip extending inward from the back interior surface of the back opposing end wall the distance greater than the aperture distance; the left releasable locking lip extending inward from the left interior surface of the left opposing side wall the distance greater than the aperture distance; and the right releasable locking lip extending inward from the right interior surface of the right opposing side wall the distance greater than the aperture distance.

In some embodiments, the systems described herein relate to a locking, protective vent grill cover system, wherein protective vent grill cover system is made of an elastomeric material.

In some embodiments, the systems described herein relate to a locking, protective vent grill cover system, wherein the elastomeric material is at least one of silicone, rubber, polyurethane, cloth, foam, and acrylic.

In some embodiments, the systems described herein relate to a locking, protective vent grill cover system, wherein the protective vent grill cover system is made of silicone and the protective top cover is five millimeters thick.

In some embodiments, the systems described herein relate to a locking, protective vent grill cover system, wherein the protective top cover further includes raised portions for padding, the raised portions extending upward from the protective top cover.

In some embodiments, the systems described herein relate to a locking, protective vent grill cover system, wherein disengagement of the locking system, includes: release of the releasable locking lip, including release of at least one of: the front releasable locking lip extending inward from the front interior surface of the front opposing end wall; the back releasable locking lip extending inward from the back interior surface of the back opposing end wall; the left releasable locking lip extending inward from the left interior surface of the left opposing side wall; and the right releasable locking lip extending inward from the right interior surface of the right opposing side wall.

In some embodiments, the systems described herein relate to a locking, protective vent grill cover system, wherein disengagement of the locking system, includes: release of the releasable locking lip, including release of all of: the front releasable locking lip extending inward from the front interior surface of the front opposing end wall; the back releasable locking lip extending inward from the back interior surface of the back opposing end wall; the left releasable locking lip extending inward from the left interior surface of the left opposing side wall; and the right releasable locking lip extending inward from the right interior surface of the right opposing side wall.

In some embodiments, the systems described herein relate to a locking, protective vent grill cover system, wherein disengagement of the locking system, includes: release of the releasable locking lip, including release of at least two of: the front releasable locking lip extending inward from the front interior surface of the front opposing end wall; the back releasable locking lip extending inward from the back interior surface of the back opposing end wall; the left releasable locking lip extending inward from the left interior surface of the left opposing side wall; and the right releasable locking lip extending inward from the right interior surface of the right opposing side wall.

In some embodiments, the systems described herein relate to a locking, protective vent grill cover system, wherein disengagement of the locking system, includes: release of the releasable locking lip, including release of at least three of: the front releasable locking lip extending inward from the front interior surface of the front opposing end wall; the back releasable locking lip extending inward from the back interior surface of the back opposing end wall; the left releasable locking lip extending inward from the left interior surface of the left opposing side wall; and the right releasable locking lip extending inward from the right interior surface of the right opposing side wall.

In some embodiments, the systems described herein relate to a locking, protective vent grill cover system including: a protective top cover configured to provide cushioning against external impact including a top cover rectangular perimeter, the top cover rectangular perimeter including: hexagonal shaped apertures, the hexagonal shaped apertures being through the protective top cover allowing for airflow through a duct connected to a vent grill; a front rectangular perimeter; a back rectangular perimeter; a left side rectangular perimeter; and a right side rectangular perimeter; an underside opposite of the protective top cover configured to lock to a vent grill; a front opposing end wall extending below the front rectangular perimeter of the top cover rectangular perimeter, the front opposing end wall including: a front interior surface of the front opposing end wall; and a front exterior surface of the front opposing end wall; a back opposing end wall extending below the back rectangular perimeter of the top cover rectangular perimeter and opposing the front opposing end wall, the back opposing end wall including: a back interior surface of the back opposing end wall; and a back exterior surface of the back opposing end wall; a left opposing side wall extending below the left side rectangular perimeter of the top cover rectangular perimeter, the left opposing side wall including: a left interior surface of the left opposing side wall; and a left exterior surface of the left opposing side wall; a right opposing side wall extending below the right side rectangular perimeter of the top cover rectangular perimeter and opposing the left opposing side wall, the right opposing side wall including: a right interior surface of the right opposing side wall; and a right exterior surface of the right opposing side wall; and a locking system, including; a releasable locking lip, including: a front releasable locking lip extending inward from the front interior surface of the front opposing end wall; a back releasable locking lip extending inward from the back interior surface of the back opposing end wall; a left releasable locking lip extending inward from the left interior surface of the left opposing side wall; and a right releasable locking lip extending inward from the right interior surface of the right opposing side wall; the releasable locking lip being aligned with a perimeter of the vent grill when the locking, protective vent grill cover system is in a locked position covering the vent grill, the locked position including: the front releasable locking lip engaging and covering a front edge perimeter of the vent grill; the back releasable locking lip engaging and covering a back edge perimeter of the vent grill; the left releasable locking lip engaging and covering a left edge perimeter of the vent grill; and the right releasable locking lip engaging and covering a right edge perimeter of the vent grill.

In some embodiments, the systems described herein relate to a locking, protective vent grill cover system including: a protective top cover configured to provide cushioning against external impact including a top cover perimeter, the top cover perimeter including: an underside opposite of the protective top cover configured to lock to a vent grill including a releasable locking lip; and a locking system, including; the releasable locking lip being aligned with a perimeter of the vent grill when the locking, protective vent grill cover system is in a locked position covering the vent grill, the locked position including: the releasable locking lip engaging and covering at least one edge of the vent grill.

In some embodiments, the systems described herein relate to a locking, protective vent grill cover system, wherein the protective top cover is a rectangular shape, a square shape, or a circle shape.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DESCRIPTION OF EXEMPLARY EMBODIMENTS

Figure 1:
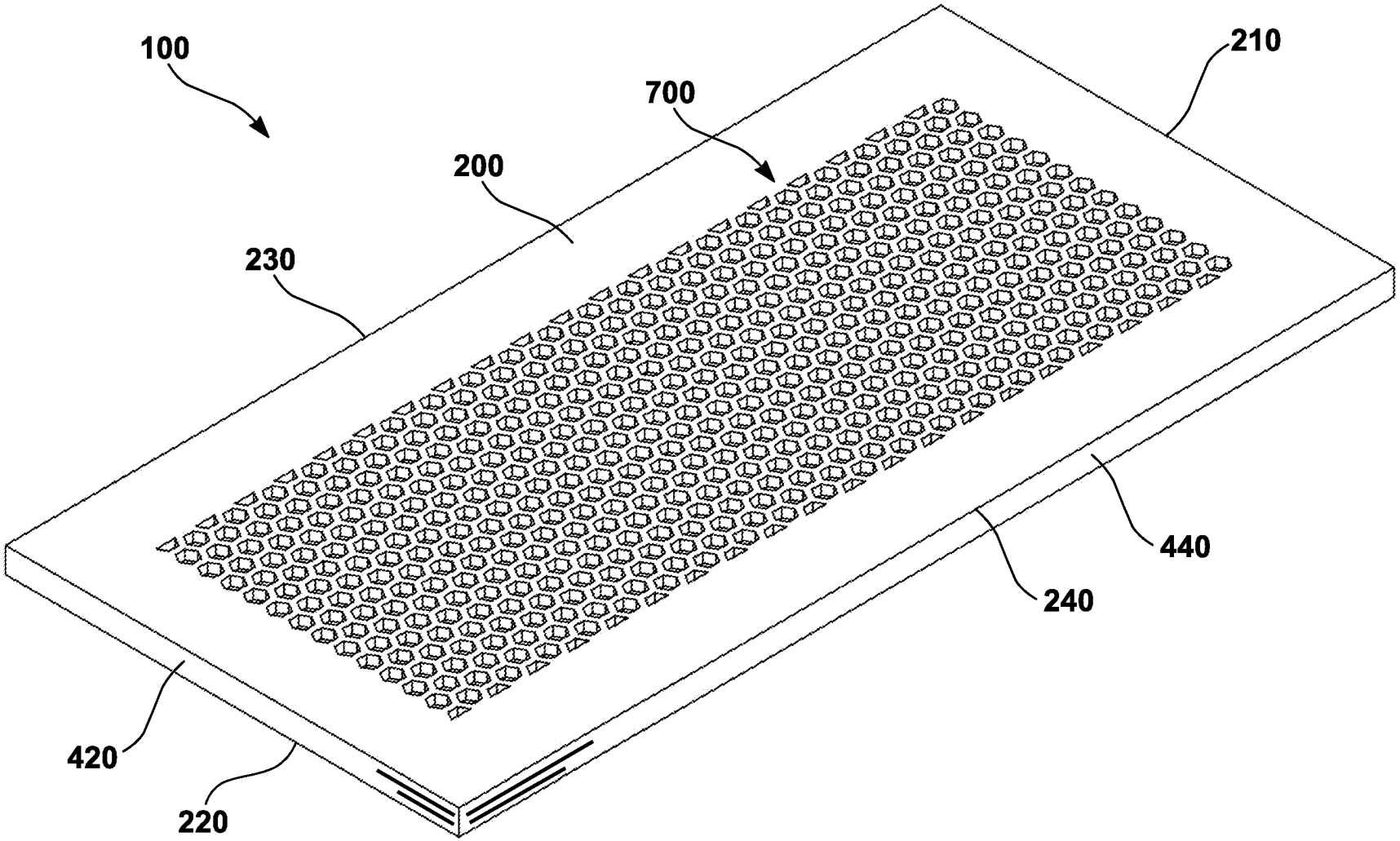
FIG. 1 illustrates a top perspective view of the locking, protective vent grill cover system according to various embodiments of the present technology.

Embodiments of the present disclosure are directed to a locking, protective vent grill cover system, and more particularly, a locking, protective vent grill cover system for baby proofing.

Parents rely on baby proofing products to reduce the likelihood of bodily injury caused by everyday household items. For example, outlet covers are used to prevent children from sticking their fingers into outlet receptacles. A household item that demands a preventative baby proofing solution is the common air vent grill also known as a register. Air vent grills pose many potential dangers to young children. Many vent grills have sharp edges that present a laceration risk to children in the house. Air vent grills are commonly constructed of material such as metal, hard plastic or other hard materials. This unforgiving and rigid material creates a potential hazard for young children. Especially young children that are learning to walk. Hitting the head, knee or any other body part onto the vent register can cause significant injury to the child. Often air vent grills are placed in floors and lower walls which are easily accessible to young children. There exists a need for a baby proofing solution for air vent grills.

Traditional Heating, Ventilation, and Air Conditioning (HVAC) vent covers, often made of metal or plastic, not only lack aesthetic appeal, but also can be a source of danger to babies, animals, and even adults. The sharp edges of traditional HVAC vent covers are a hazard, and the wide vent gaps can allow for loss of small objects down the HVAC vent. In various embodiments the present technology disclosed herein serves to improve safety by protecting the sharp edges and large gaps and improves the aesthetic of traditional HVAC vent covers by allowing more choice in color and design.

HVAC systems in commercial and residential facilities comprise vents from HVAC units to outlets that are distributed throughout the facility. These outlets are usually covered with a vent cover that directs airflow through the outlet and creates an aesthetic finish that is more than a simple hole in the wall or floor. Traditional HVAC vent covers are typically made of hard and aesthetically unappealing materials such as metal or plastic. These materials not only lack aesthetic appeal but also pose the risk of injury because of the sharp edges against which people or animals may get caught. Some embodiments of vent covers have vanes, slots, or the like which direct airflow through the vent which have sharp edges that can cut a person. Babies, animals, and even adults are capable of dropping objects down the HVAC vent through the wide openings in traditional HVAC vent covers and may even injure themselves on the sharp metal edges which characterize many traditional HVAC vent covers.

Embodiments of the present technology include a protector for an HVAC vent cover that protects humans of all ages and even animals from the sharp edges of traditional HVAC vent covers. The protector safeguards household members from risk of injury and provides peace of mind to adults in charge of young children or animals who could hurt themselves or drop important objects down the vent.

Various embodiments of the present technology include a protector for an HVAC vent cover. In various embodiments, the HVAC vent cover has a top face, with an underside against which the HVAC vent cover is mounted to an HVAC duct. The top face of the HVAC vent cover has openings for airflow through the duct. The HVAC vent cover protector has a top surface that covers the top face of the HVAC vent cover. This top surface may have perforations to allow for airflow through the HVAC vent. The underside of the top surface of the HVAC vent cover protector has a side wall extending downwards from the perimeter of the protector a distance at least equivalent to the thickness of the HVAC vent cover top face and a lip that extends inward from the bottom of said side wall along the underside of said top surface.

In some embodiments of the present technology, a vent cover protector includes a top surface which covers the HVAC vent cover. The HVAC vent cover has a vent cover top face and a vent cover underside against which the HVAC vent cover is mounted to a duct, the vent cover top face has vent cover openings which may be vanes for airflow through the duct.

In various embodiments, the top surface of the protector is of a thickness that provides cushioning against external impact. Some embodiments may have raised portions on the top surface of the protector for additional cushion from external impact. Embodiments of the present technology include side walls of the protector which extend downward from the perimeter of the top surface to enclose the edges of the existing HVAC vent cover.

In various embodiments, the top surface may have holes or perforations for airflow through the duct. The perforations may be a size, shape, and spacing to limit the restriction of airflow through the protector. The actual size, shape, and space of the perforations may be varied by the particular application but in any case should be sufficient to protect people and animals from the sharp edges of the vanes of the HVAC vent cover and provide additional protection against items falling through the vanes of the HVAC vent cover. Some embodiments may feature different configurations, sizes, and numbers of perforations, or even no perforations at all. In embodiments in which the protector has no perforations, the protector would block airflow through the vent and could be used as an energy saving device.

In various embodiments, the perforations may also serve to prevent loss of objects down the vent or injury by way of insertion of fingers or other body parts into the openings of traditional HVAC vent covers. This is achieved by customization of the perforations. Various embodiments include different configurations of the perforations, allowing for restricted access to the HVAC vent cover, thus preventing object loss or injury.

In various embodiments of the present technology, the top surface of the protector has an underside which rests against the top of the HVAC vent cover. In some embodiments the side walls extending downwards from the perimeter of the underside of the top surface of the protector a distance at least equivalent to the thickness of the top of the HVAC vent cover allowing the protector to encompass all exposed sharp edges on the HVAC vent cover. Furthermore, this secures the protector to the vent and makes it less able to be inadvertently removed In various embodiments of the present technology, the protector has a lip that extends inward from the bottom of the side walls along the underside of the top surface. This lip further secures the protector against the HVAC vent cover and allows the protector to be mounted to the HVAC vent cover without fasteners or glues. There may be some embodiments of protector that do not have a lip.

In various embodiments of the present technology the HVAC vent cover protector can be made of an elastomeric material such as silicone, rubber, polyurethane, cloth, foam, or acrylic. These materials allow for both aesthetic and safety customization. In some embodiments, the top surface has raised portions along the perimeter of the top surface to allow for cushion from external impact. Various embodiments of the protector can also be of differing shapes including but not limited to: rectangular, square, or circle. These shapes can be made to conform to the specific HVAC vent cover to which the protector is to be mounted. This allows for universal compatibility across HVAC vent covers of varying types.

In various embodiments of the present technology, the present technology serves to shield pets, babies, and even adults from injury caused by bumping into the sharp edges commonly present on traditional HVAC vent covers. The present technology does so by stretching over the existing HVAC vent cover and protecting all exposed edges of the installed HVAC vent cover. The present technology may also protect from injury via insertion of appendages into the slots on traditional HVAC vent covers by covering and restricting access to the existing HVAC vent.

FIG. 1 illustrates a top perspective view of the locking, protective vent grill cover system 100 according to various embodiments of the present technology. FIG. 1 shows the locking, protective vent grill cover system 100 comprising: a protective top cover 200 configured to provide cushioning against external impact comprising a top cover rectangular perimeter, the top cover rectangular perimeter comprising: a front rectangular perimeter 210; a back rectangular perimeter 220; a left side rectangular perimeter 230; and a right side rectangular perimeter 240. FIG. 1 also shows a back interior surface 422 of the back opposing end wall 420 and a right exterior surface 444 of the right opposing side wall 440.

Figure 2:
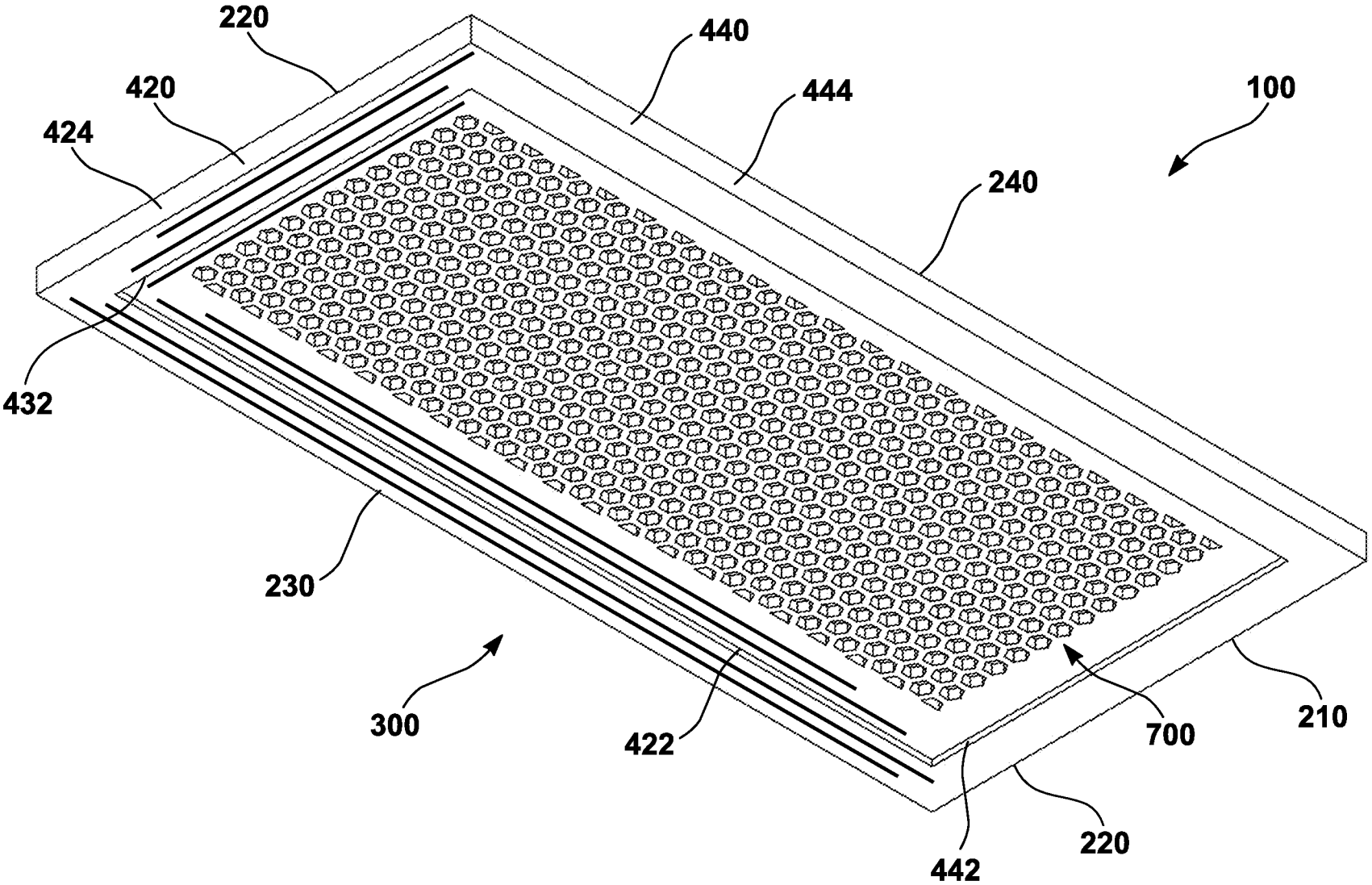
FIG. 2 illustrates a bottom perspective view of the locking, protective vent grill cover system according to various embodiments of the present technology.

FIG. 2 illustrates a bottom perspective view of the locking, protective vent grill cover system 100 according to various embodiments of the present technology. FIG. 2 shows an underside 300 opposite of the protective top cover 200 configured to lock to a vent grill; a front opposing end wall 410 extending below the front rectangular perimeter 210 of the top cover rectangular perimeter, the front opposing end wall 410 comprising: a front interior surface 412 of the front opposing end wall 410; and a front exterior surface 414 of the front opposing end wall 410; a back opposing end wall 420 extending below the back rectangular perimeter 220 of the top cover rectangular perimeter and opposing the front opposing end wall 410, the back opposing end wall 420 comprising: a back interior surface 422 of the back opposing end wall 420; and a back exterior surface 424 of the back opposing end wall 420; a left opposing side wall 430 extending below the left side rectangular perimeter 230 of the top cover rectangular perimeter, the left opposing side wall 430 comprising: a left interior surface 432 of the left opposing side wall 430; and a left exterior surface 434 of the left opposing side wall 430; a right opposing side wall 440 extending below the right side rectangular perimeter 240 of the top cover rectangular perimeter and opposing the left opposing side wall 430, the right opposing side wall 440 comprising: a right interior surface 442 of the right opposing side wall 440; and a right exterior surface 444 of the right opposing side wall 440.

Figure 3:
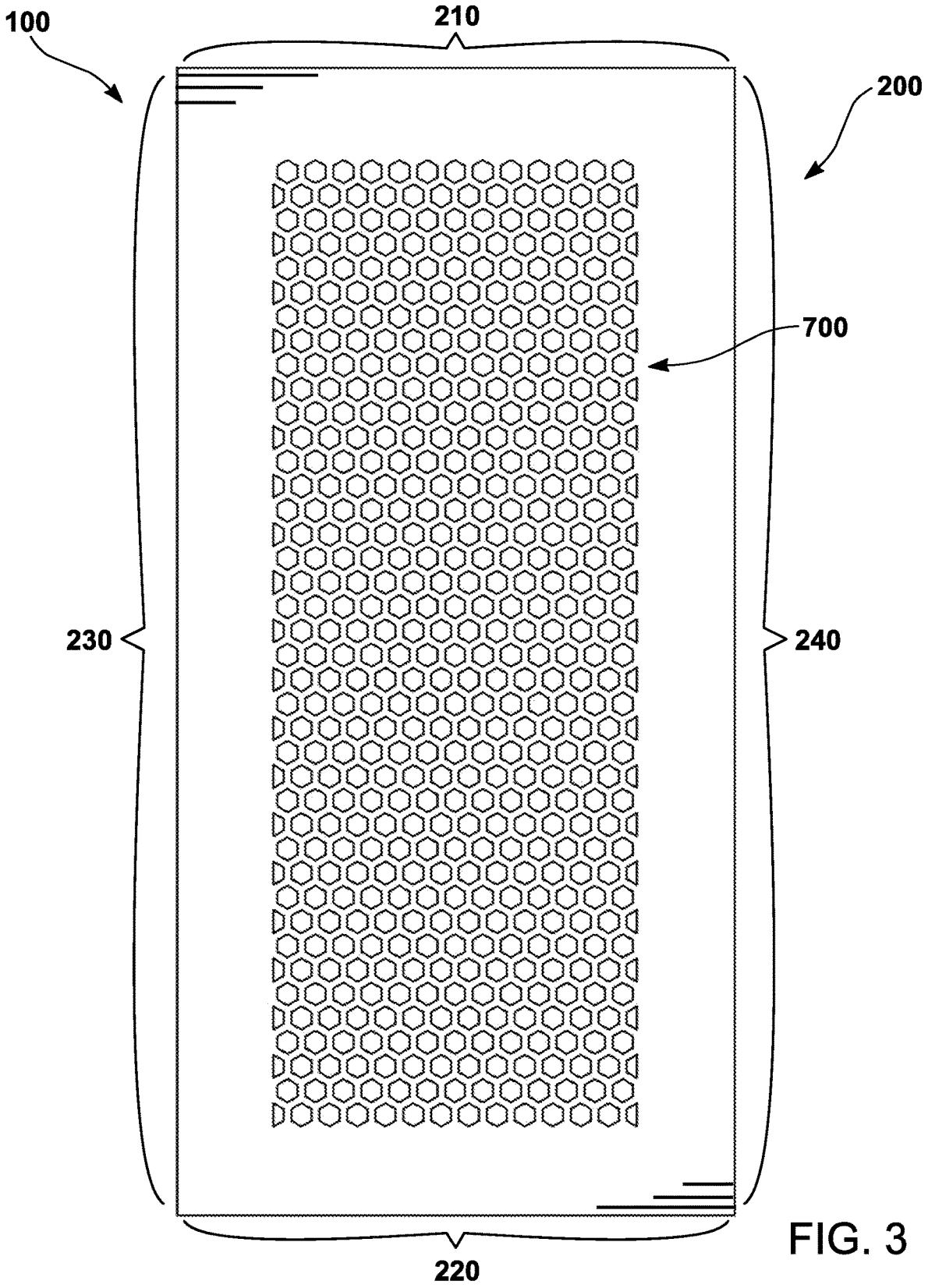
FIG. 3 illustrates a top view of the locking, protective vent grill cover system according to various embodiments of the present technology.

FIG. 3 illustrates a top view of the locking, protective vent grill cover system 100 according to various embodiments of the present technology. FIG. 3 shows the locking, protective vent grill cover system 100 comprising: a protective top cover 200 configured to provide cushioning against external impact comprising a top cover rectangular perimeter, the top cover rectangular perimeter comprising: a front rectangular perimeter 210; a back rectangular perimeter 220; a left side rectangular perimeter 230; and a right side rectangular perimeter 240.

Figure 4:
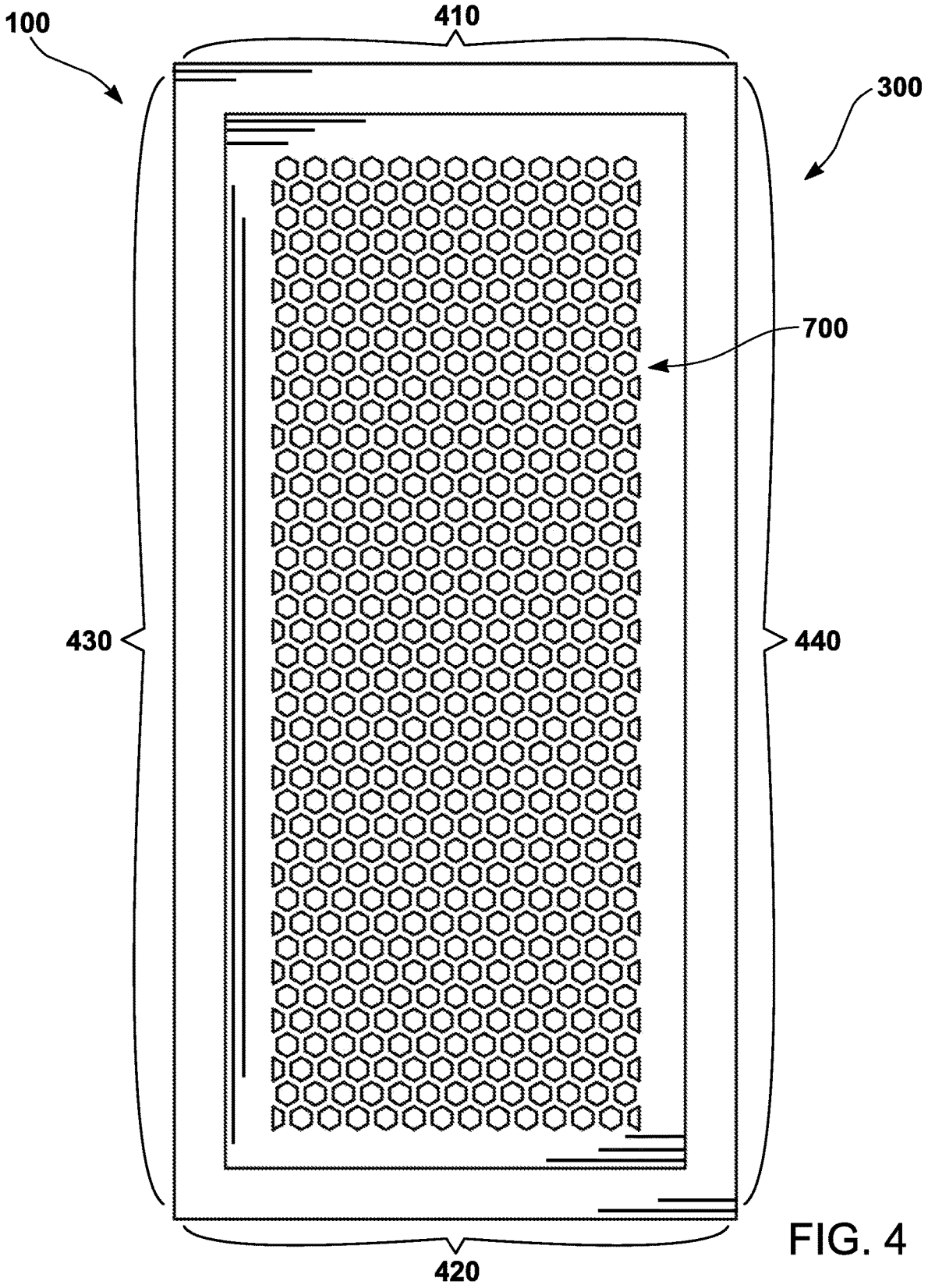
FIG. 4 illustrates a bottom view of the locking, protective vent grill cover system according to various embodiments of the present technology.

FIG. 4 illustrates a bottom view of the locking, protective vent grill cover system 100 according to various embodiments of the present technology. FIG. 4 shows an underside 300 opposite of the protective top cover 200 configured to lock to a vent grill; a front opposing end wall 410 extending below the front rectangular perimeter 210 of the top cover rectangular perimeter, the front opposing end wall 410 comprising: a front interior surface 412 of the front opposing end wall 410; and a front exterior surface 414 of the front opposing end wall 410; a back opposing end wall 420 extending below the back rectangular perimeter 220 of the top cover rectangular perimeter and opposing the front opposing end wall 410, the back opposing end wall 420 comprising: a back interior surface 422 of the back opposing end wall 420; and a back exterior surface 424 of the back opposing end wall 420; a left opposing side wall 430 extending below the left side rectangular perimeter 230 of the top cover rectangular perimeter, the left opposing side wall 430 comprising: a left interior surface 432 of the left opposing side wall 430; and a left exterior surface 434 of the left opposing side wall 430; a right opposing side wall 440 extending below the right side rectangular perimeter 240 of the top cover rectangular perimeter and opposing the left opposing side wall 430, the right opposing side wall 440 comprising: a right interior surface 442 of the right opposing side wall 440; and a right exterior surface 444 of the right opposing side wall 440.

Figure 5:
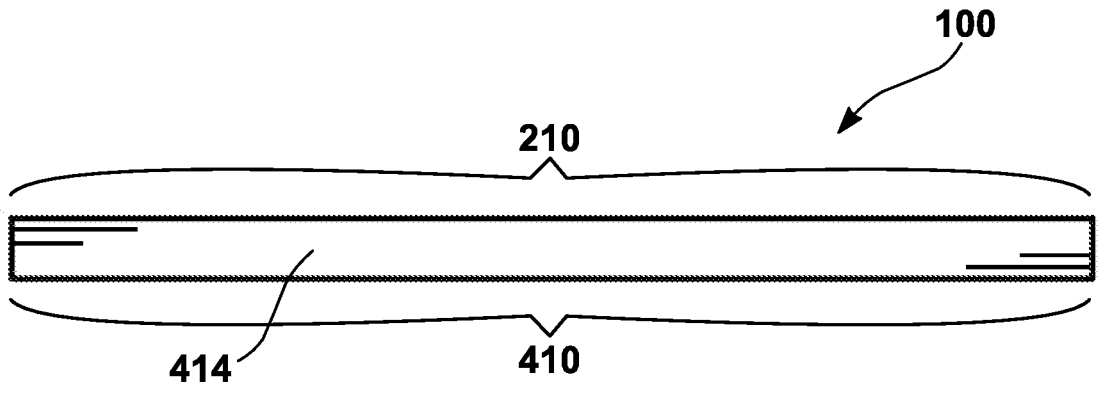
FIG. 5 illustrates a front view of the locking, protective vent grill cover system according to various embodiments of the present technology.
Figure 6:
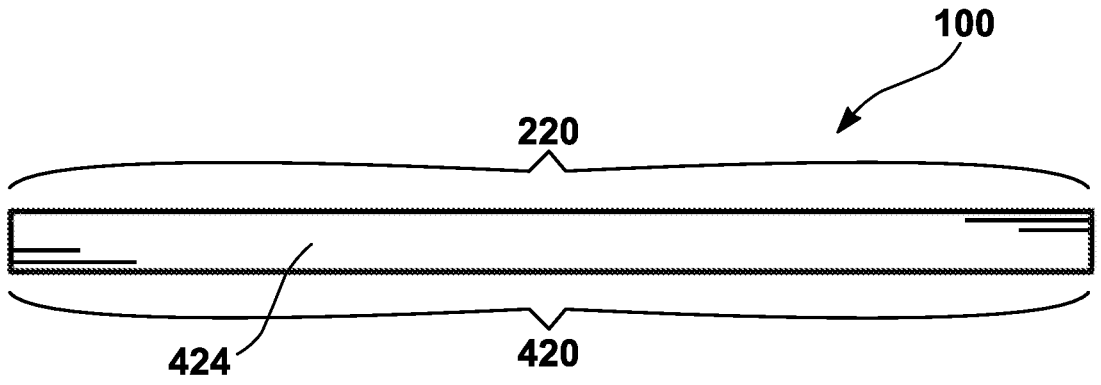
FIG. 6 illustrates a back view of the locking, protective vent grill cover system according to various embodiments of the present technology.

FIG. 5 illustrates a front view of the locking, protective vent grill cover system 100 according to various embodiments of the present technology. FIG. 5 shows the front opposing end wall 410 extending below the front rectangular perimeter 210 of the top cover rectangular perimeter, the front opposing end wall 410 comprising: a front interior surface 412 of the front opposing end wall 410; and a front exterior surface 414 of the front opposing end wall 410;

FIG. 6 illustrates a back view of the locking, protective vent grill cover system 100 according to various embodiments of the present technology. FIG. 6 shows a back opposing end wall 420 extending below the back rectangular perimeter 220 of the top cover rectangular perimeter and opposing the front opposing end wall 410, the back opposing end wall 420 comprising: a back interior surface 422 of the back opposing end wall 420; and a back exterior surface 424 of the back opposing end wall 420.

Figure 7:
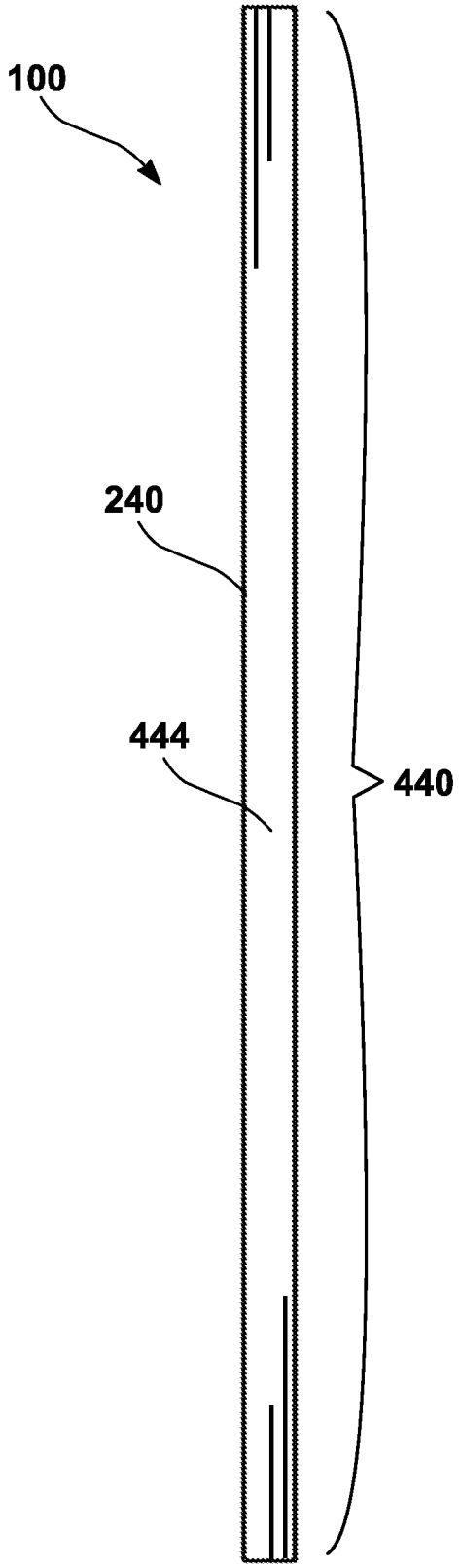
FIG. 7 illustrates a right view of the locking, protective vent grill cover system according to various embodiments of the present technology.

FIG. 7 illustrates a right view of the locking, protective vent grill cover system 100 according to various embodiments of the present technology. FIG. 7 shows a right opposing side wall 440 extending below the right side rectangular perimeter 240 of the top cover rectangular perimeter and opposing the left opposing side wall 430, the right opposing side wall 440 comprising: a right interior surface 442 of the right opposing side wall 440; and a right exterior surface 444 of the right opposing side wall 440.

Figure 8:
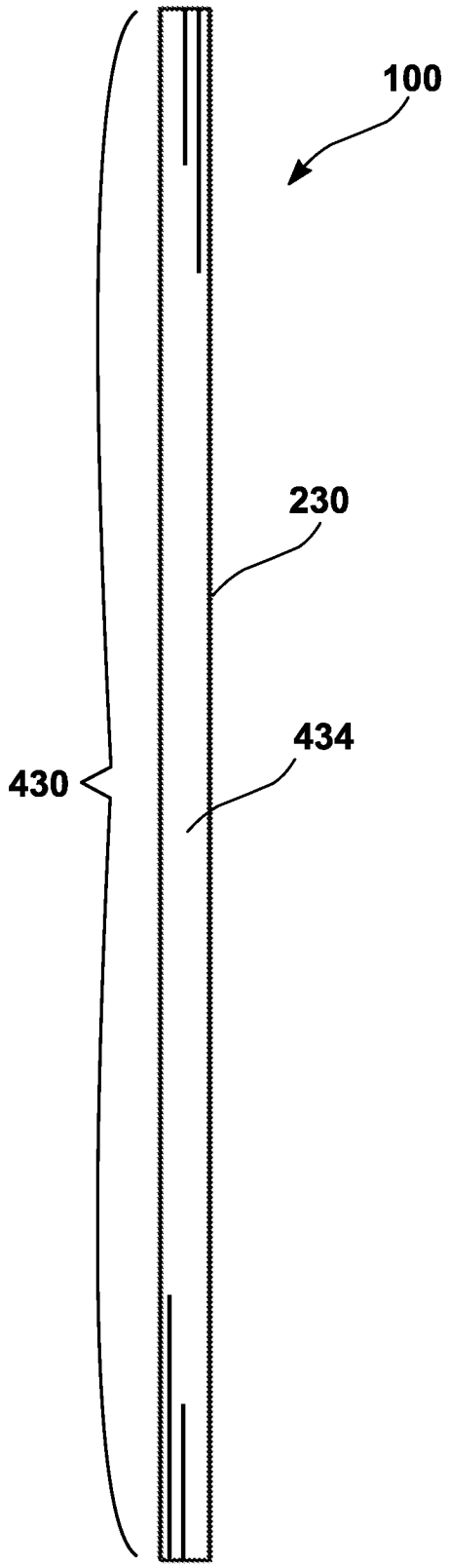
FIG. 8 illustrates a left view of the locking, protective vent grill cover system according to various embodiments of the present technology.

FIG. 8 illustrates a left view of the locking, protective vent grill cover system 100 according to various embodiments of the present technology. FIG. 8 shows the left opposing side wall 430 extending below the left side rectangular perimeter 230 of the top cover rectangular perimeter, the left opposing side wall 430 comprising: a left interior surface 432 of the left opposing side wall 430; and a left exterior surface 434 of the left opposing side wall 430.

Figure 9:
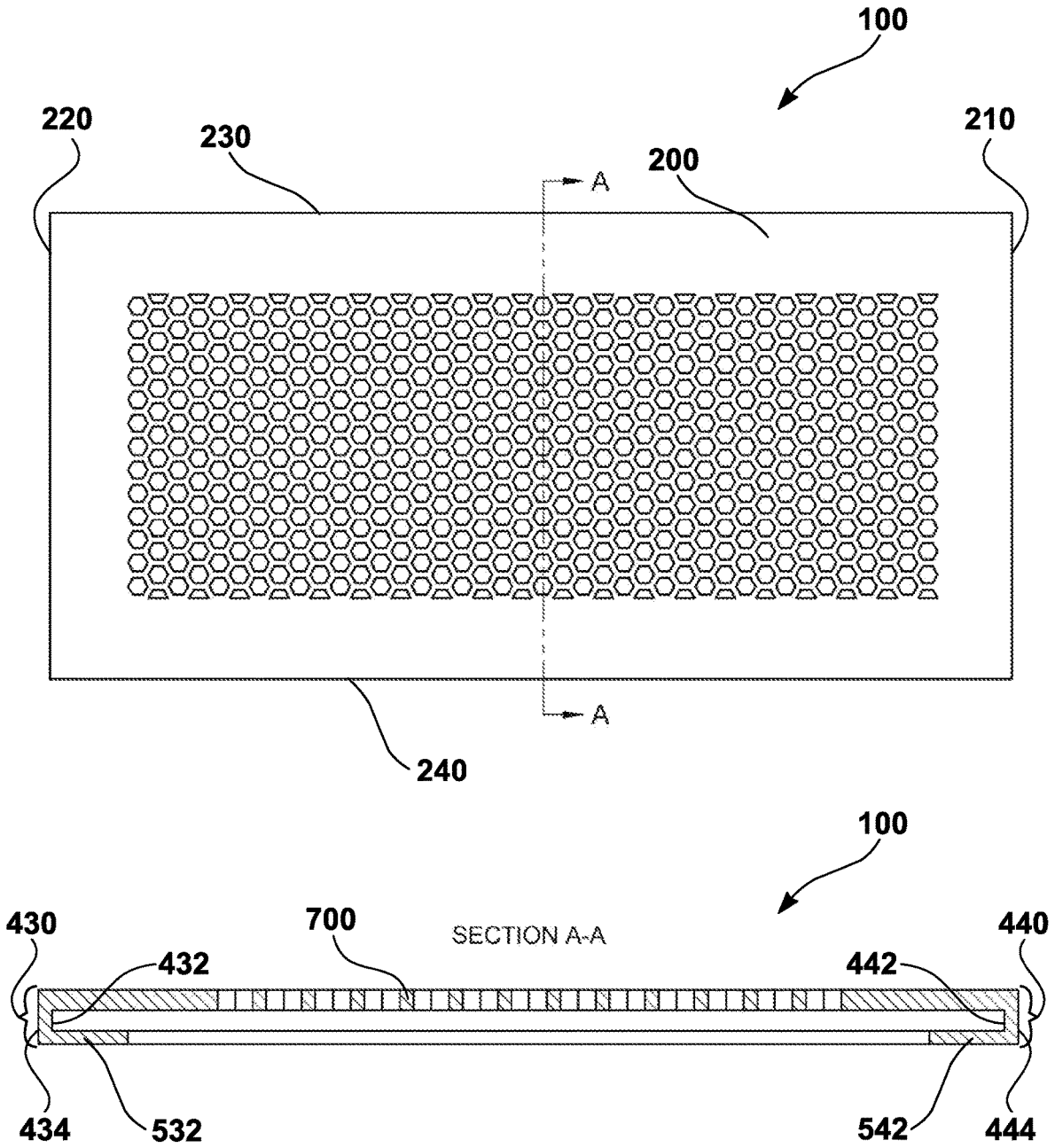
FIG. 9 shows a transverse cross-section of the locking, protective vent grill cover system according to various embodiments of the present technology.

FIG. 9 shows a transverse cross-section of the locking, protective vent grill cover system 100 according to various embodiments of the present technology. FIG. 9 shows the locking, protective vent grill cover system 100 comprising: a protective top cover 200 configured to provide cushioning against external impact comprising a top cover rectangular perimeter, the top cover rectangular perimeter comprising: a front rectangular perimeter 210; a back rectangular perimeter 220; a left side rectangular perimeter 230; and a right side rectangular perimeter 240.

FIG. 9 further shows a left opposing side wall 430 extending below the left side rectangular perimeter 230 of the top cover rectangular perimeter, the left opposing side wall 430 comprising: a left interior surface 432 of the left opposing side wall 430; and a left exterior surface 434 of the left opposing side wall 430; a right opposing side wall 440 extending below the right side rectangular perimeter 240 of the top cover rectangular perimeter and opposing the left opposing side wall 430, the right opposing side wall 440 comprising: a right interior surface 442 of the right opposing side wall 440; and a right exterior surface 444 of the right opposing side wall 440.

FIG. 9 further shows a left releasable locking lip 532 extending inward from the left interior surface 432 of the left opposing side wall 430; and a right releasable locking lip 542 extending inward from the right interior surface 442 of the right opposing side wall 440.

Figure 10:
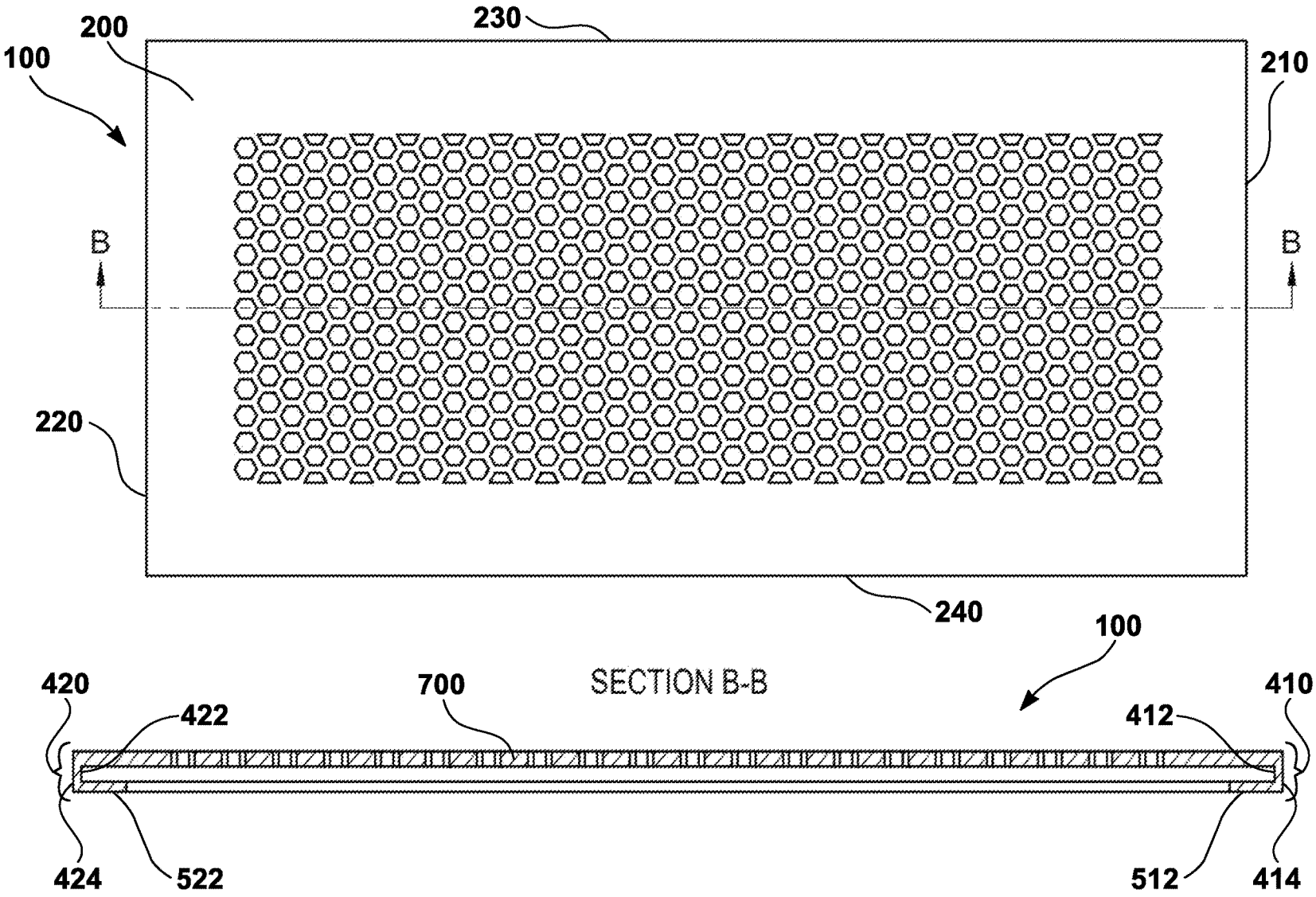
FIG. 10 shows a longitude cross-sections of the locking, protective vent grill cover system according to various embodiments of the present technology.

FIG. 10 shows a longitude cross-sections of the locking, protective vent grill cover system 100 according to various embodiments of the present technology. FIG. 10 shows the locking, protective vent grill cover system 100 comprising: a protective top cover 200 configured to provide cushioning against external impact comprising a top cover rectangular perimeter, the top cover rectangular perimeter comprising: a front rectangular perimeter 210; a back rectangular perimeter 220; a left side rectangular perimeter 230; and a right side rectangular perimeter 240.

FIG. 10 further shows a front opposing end wall 410 extending below the front rectangular perimeter 210 of the top cover rectangular perimeter, the front opposing end wall 410 comprising: a front interior surface 412 of the front opposing end wall 410; and a front exterior surface 414 of the front opposing end wall 410; a back opposing end wall 420 extending below the back rectangular perimeter 220 of the top cover rectangular perimeter and opposing the front opposing end wall 410, the back opposing end wall 420 comprising: a back interior surface 422 of the back opposing end wall 420; and a back exterior surface 424 of the back opposing end wall 420.

Figure 11:
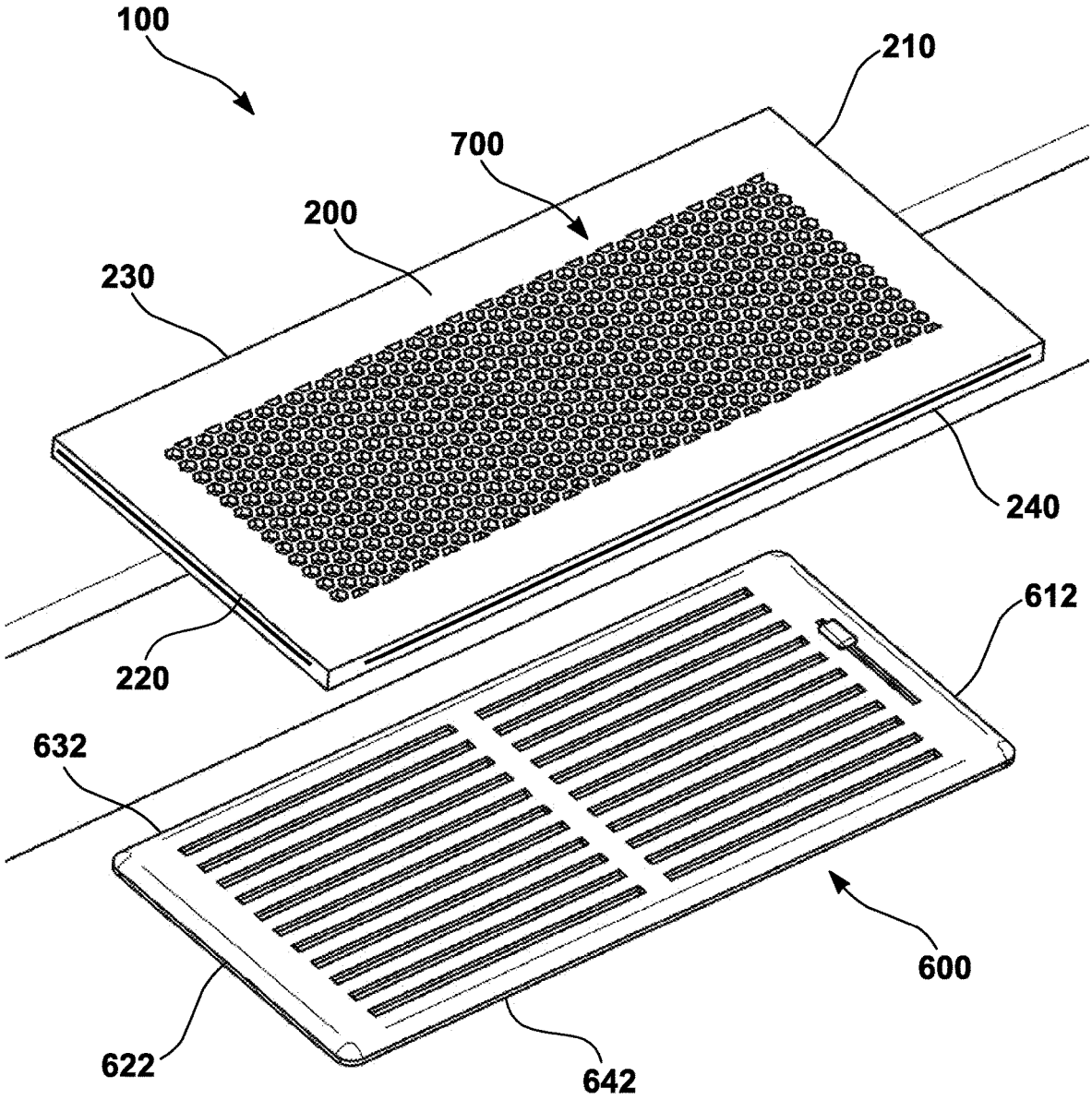
FIG. 11 illustrates a top perspective view of the locking, protective vent grill cover system before being placed on a vent grill according to various embodiments of the present technology.

FIG. 11 illustrates a top perspective view of the locking, protective vent grill cover system 100 before being placed on a vent grill according to various embodiments of the present technology. FIG. 11 shows the locking, protective vent grill cover system 100 comprising: a protective top cover 200 configured to provide cushioning against external impact comprising a top cover rectangular perimeter, the top cover rectangular perimeter comprising: a front rectangular perimeter 210; a back rectangular perimeter 220; a left side rectangular perimeter 230; and a right side rectangular perimeter 240.

FIG. 11 further shows a locking system, comprising; a releasable locking lip, comprising: a front releasable locking lip 512 extending inward from the front interior surface 412 of the front opposing end wall 410; a back releasable locking lip 522 extending inward from the back interior surface 422 of the back opposing end wall 420; a left releasable locking lip 532 extending inward from the left interior surface 432 of the left opposing side wall 430; and a right releasable locking lip 542 extending inward from the right interior surface 442 of the right opposing side wall 440; the releasable locking lip being aligned with a perimeter of the vent grill 600 when the locking, protective vent grill cover system 100 is in a locked position covering the vent grill, the locked position comprising: the front releasable locking lip 512 engaging and covering a front edge perimeter 612 of the vent grill; the back releasable locking lip 522 engaging and covering a back edge perimeter 622 of the vent grill 600; the left releasable locking lip 532 engaging and covering a left edge perimeter 632 of the vent grill 600; and the right releasable locking lip 542 engaging and covering a right edge perimeter 642 of the vent grill 600.

Figure 12:
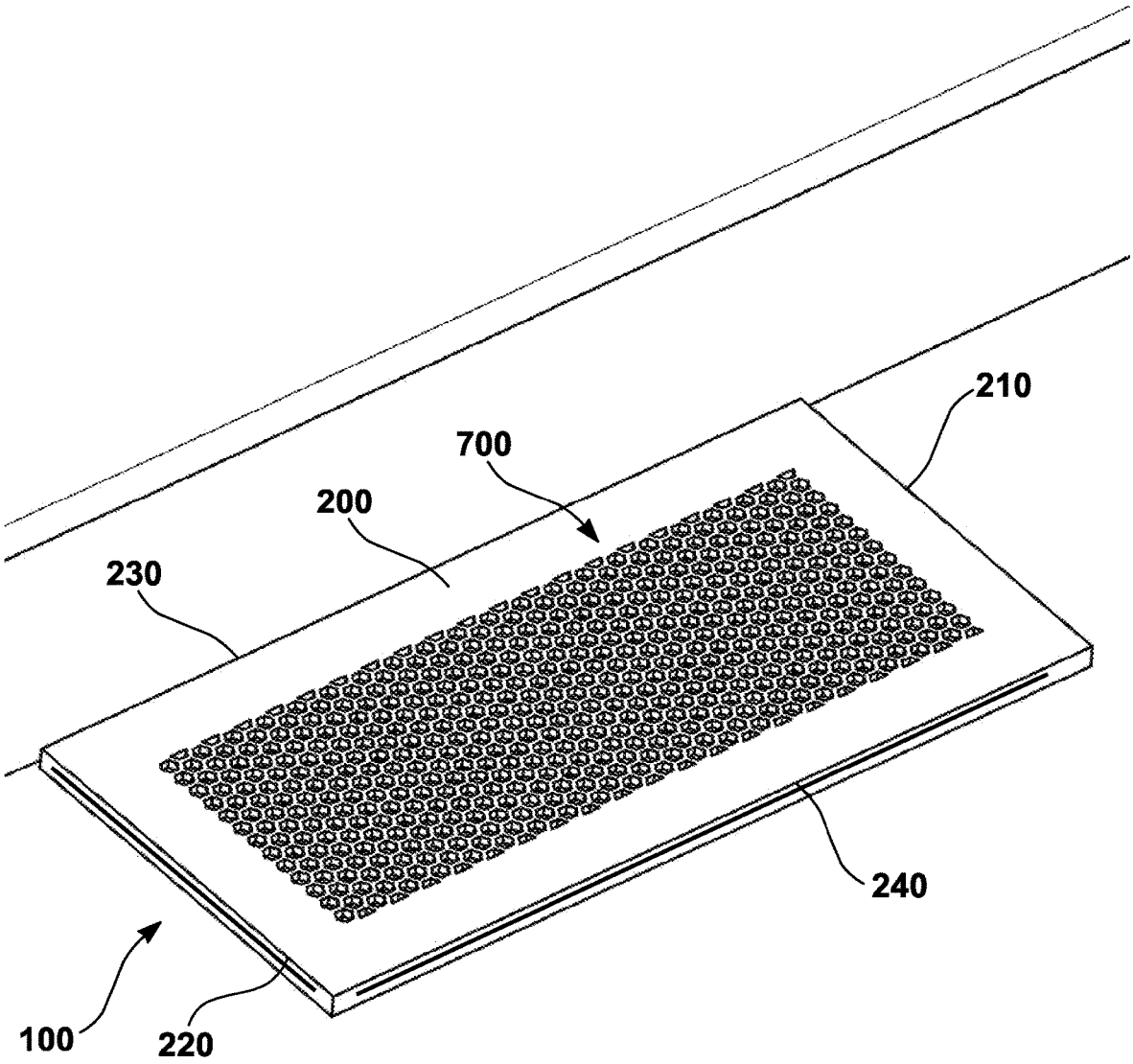
FIG. 12 illustrates a top perspective view of the locking, protective vent grill cover system in use after being placed on a vent grill according to various embodiments of the present technology.

FIG. 12 illustrates a top perspective view of the locking, protective vent grill cover system 100 in use after being placed on a vent grill according to various embodiments of the present technology. FIG. 12 shows the locking, protective vent grill cover system 100 comprising: a protective top cover 200 configured to provide cushioning against external impact comprising a top cover rectangular perimeter, the top cover rectangular perimeter comprising: a front rectangular perimeter 210; a back rectangular perimeter 220; a left side rectangular perimeter 230; and a right side rectangular perimeter 240.

FIG. 12 further shows a locking system, comprising; a releasable locking lip, comprising: a front releasable locking lip 512 extending inward from the front interior surface 412 of the front opposing end wall 410; a back releasable locking lip 522 extending inward from the back interior surface 422 of the back opposing end wall 420; a left releasable locking lip 532 extending inward from the left interior surface 432 of the left opposing side wall 430; and a right releasable locking lip 542 extending inward from the right interior surface 442 of the right opposing side wall 440; the releasable locking lip being aligned with a perimeter of the vent grill 600 when the locking, protective vent grill cover system 100 is in a locked position covering the vent grill, the locked position comprising: the front releasable locking lip 512 engaging and covering a front edge perimeter 612 of the vent grill; the back releasable locking lip 522 engaging and covering a back edge perimeter 622 of the vent grill 600; the left releasable locking lip 532 engaging and covering a left edge perimeter 632 of the vent grill 600; and the right releasable locking lip 542 engaging and covering a right edge perimeter 642 of the vent grill 600.

Some embodiments of the present technology include a locking, protective vent grill cover system 100 comprising: a protective top cover 200 configured to provide cushioning against external impact comprising a top cover rectangular perimeter, the top cover rectangular perimeter comprising: a front rectangular perimeter 210; a back rectangular perimeter 220; a left side rectangular perimeter 230; and a right side rectangular perimeter 240; an underside 300 opposite of the protective top cover 200 configured to lock to a vent grill; a front opposing end wall 410 extending below the front rectangular perimeter 210 of the top cover rectangular perimeter, the front opposing end wall 410 comprising: a front interior surface 412 of the front opposing end wall 410; and a front exterior surface 414 of the front opposing end wall 410; a back opposing end wall 420 extending below the back rectangular perimeter 220 of the top cover rectangular perimeter and opposing the front opposing end wall 410, the back opposing end wall 420 comprising: a back interior surface 422 of the back opposing end wall 420; and a back exterior surface 424 of the back opposing end wall 420; a left opposing side wall 430 extending below the left side rectangular perimeter 230 of the top cover rectangular perimeter, the left opposing side wall 430 comprising: a left interior surface 432 of the left opposing side wall 430; and a left exterior surface 434 of the left opposing side wall 430; a right opposing side wall 440 extending below the right side rectangular perimeter 240 of the top cover rectangular perimeter and opposing the left opposing side wall 430, the right opposing side wall 440 comprising: a right interior surface 442 of the right opposing side wall 440; and a right exterior surface 444 of the right opposing side wall 440; and a locking system, comprising; a releasable locking lip, comprising: a front releasable locking lip 512 extending inward from the front interior surface 412 of the front opposing end wall 410; a back releasable locking lip 522 extending inward from the back interior surface 422 of the back opposing end wall 420; a left releasable locking lip 532 extending inward from the left interior surface 432 of the left opposing side wall 430; and a right releasable locking lip 542 extending inward from the right interior surface 442 of the right opposing side wall 440; the releasable locking lip being aligned with a perimeter of the vent grill 600 when the locking, protective vent grill cover system 100 is in a locked position covering the vent grill, the locked position comprising: the front releasable locking lip 512 engaging and covering a front edge perimeter 612 of the vent grill; the back releasable locking lip 522 engaging and covering a back edge perimeter 622 of the vent grill 600; the left releasable locking lip 532 engaging and covering a left edge perimeter 632 of the vent grill 600; and the right releasable locking lip 542 engaging and covering a right edge perimeter 642 of the vent grill 600.

In some embodiments of the present technology the protective top cover 200 further comprises apertures 700, the apertures 700 being through the protective top cover 200 and the underside 300 allowing for airflow through a duct connected to the vent grill 600.

In some embodiments of the present technology the apertures 700 are a hexagonal shape.

In some embodiments of the present technology the apertures 700 comprise slits, the slits being aligned with vent slits of the vent grill 600 allowing for airflow through the duct connected to the vent grill 600.

In some embodiments of the present technology the apertures 700 comprise circular holes, the circular holes having a diameter less that any opening on the vent grill 600 thereby reducing airflow through the duct connected to the vent grill 600.

In some embodiments of the present technology the protective top cover 200 is solid with no apertures inhibiting airflow through a duct connected to the vent grill 600.

In some embodiments of the present technology the releasable locking lip extends a distance equal to a thickness of the protective top cover 200 comprising: the front releasable locking lip 512 extending inward from the front interior surface 412 of the front opposing end wall 410 the distance equal to the thickness of the protective top cover; the back releasable locking lip 522 extending inward from the back interior surface 422 of the back opposing end wall 420 the distance equal to the thickness of the protective top cover; the left releasable locking lip 532 extending inward from the left interior surface 432 of the left opposing side wall 430 the distance equal to the thickness of the protective top cover; and the right releasable locking lip 542 extending inward from the right interior surface 442 of the right opposing side wall 440 the distance equal to the thickness of the protective top cover.

In some embodiments of the present technology the releasable locking lip extends a distance greater than a thickness of the protective top cover 200 comprising: the front releasable locking lip 512 extending inward from the front interior surface 412 of the distance greater than the thickness of the protective top cover; the back releasable locking lip 522 extending inward from the back interior surface 422 of the back opposing end wall 420 the distance greater than the thickness of the protective top cover; the left releasable locking lip 532 extending inward from the left interior surface 432 of the left opposing side wall 430 the distance greater than the thickness of the protective top cover 200; and the right releasable locking lip 542 extending inward from the right interior surface 442 of the right opposing side wall 440 the distance greater than the thickness of the protective top cover 200.

In some embodiments of the present technology the releasable locking lip extends a distance greater than an aperture distance, the aperture distance being a shortest distance of apertures 700 in the protective top cover 200 to the top cover rectangular perimeter comprising: the front releasable locking lip 512 extending inward from the front interior surface 412 of the front opposing end wall 410 the distance greater than the aperture distance; the back releasable locking lip 522 extending inward from the back interior surface 422 of the back opposing end wall 420 the distance greater than the aperture distance; the left releasable locking lip 532 extending inward from the left interior surface 432 of the left opposing side wall 430 the distance greater than the aperture distance; and the right releasable locking lip 542 extending inward from the right interior surface 442 of the right opposing side wall 440 the distance greater than the aperture distance.

In some embodiments of the present technology the protective vent grill cover system 100 is made of an elastomeric material.

In some embodiments of the present technology the elastomeric material is at least one of silicone, rubber, polyurethane, cloth, foam, and acrylic.

In some embodiments of the present technology the protective vent grill cover system 100 is made of silicone and the protective top cover 200 is five millimeters thick.

In some embodiments of the present technology the protective top cover 200 further comprises raised portions for padding, the raised portions extending upward from the protective top cover 200.

In some embodiments of the present technology disengagement of the locking system, comprises: release of the releasable locking lip, comprising release of at least one of: the front releasable locking lip 512 extending inward from the front interior surface 412 of the front opposing end wall 410; the back releasable locking lip 522 extending inward from the back interior surface 422 of the back opposing end wall 420; the left releasable locking lip 532 extending inward from the left interior surface 432 of the left opposing side wall 430; and the right releasable locking lip 542 extending inward from the right interior surface 442 of the right opposing side wall 440.

In some embodiments of the present technology disengagement of the locking system, comprises: release of the releasable locking lip, comprising release of all of: the front releasable locking lip 512 extending inward from the front interior surface 412 of the front opposing end wall 410; the back releasable locking lip 522 extending inward from the back interior surface 422 of the back opposing end wall 420; the left releasable locking lip 532 extending inward from the left interior surface 432 of the left opposing side wall 430; and the right releasable locking lip 542 extending inward from the right interior surface 442 of the right opposing side wall 440.

In some embodiments of the present technology disengagement of the locking system, comprises: release of the releasable locking lip, comprising release of at least two of: the front releasable locking lip 512 extending inward from the front interior surface 412 of the front opposing end wall 410; the back releasable locking lip 522 extending inward from the back interior surface 422 of the back opposing end wall 420; the left releasable locking lip 532 extending inward from the left interior surface 432 of the left opposing side wall 430; and the right releasable locking lip 542 extending inward from the right interior surface 442 of the right opposing side wall 440.

In some embodiments of the present technology disengagement of the locking system, comprises: release of the releasable locking lip, comprising release of at least three of: the front releasable locking lip 512 extending inward from the front interior surface 412 of the front opposing end wall 410; the back releasable locking lip 522 extending inward from the back interior surface 422 of the back opposing end wall 420; the left releasable locking lip 532 extending inward from the left interior surface 432 of the left opposing side wall 430; and the right releasable locking lip 542 extending inward from the right interior surface 442 of the right opposing side wall 440.

Some embodiments of the present technology include a locking, protective vent grill cover system 100 comprising: a protective top cover 200 configured to provide cushioning against external impact comprising a top cover rectangular perimeter, the top cover rectangular perimeter comprising: hexagonal shaped apertures 700, the hexagonal shaped apertures 700 being through the protective top cover 200 allowing for airflow through a duct connected to the vent grill 600; a front rectangular perimeter 210; a back rectangular perimeter 220; a left side rectangular perimeter 230; and a right side rectangular perimeter 240; an underside 300 opposite of the protective top cover 200 configured to lock to a vent grill; a front opposing end wall 410 extending below the front rectangular perimeter 210 of the top cover rectangular perimeter, the front opposing end wall 410 comprising: a front interior surface 412 of the front opposing end wall 410; and a front exterior surface 414 of the front opposing end wall 410; a back opposing end wall 420 extending below the back rectangular perimeter 220 of the top cover rectangular perimeter and opposing the front opposing end wall 410, the back opposing end wall 420 comprising: a back interior surface 422 of the back opposing end wall 420; and a back exterior surface 424 of the back opposing end wall 420; a left opposing side wall 430 extending below the left side rectangular perimeter 230 of the top cover rectangular perimeter, the left opposing side wall 430 comprising: a left interior surface 432 of the left opposing side wall 430; and a left exterior surface 434 of the left opposing side wall 430; a right opposing side wall 440 extending below the right side rectangular perimeter 240 of the top cover rectangular perimeter and opposing the left opposing side wall 430, the right opposing side wall 440 comprising: a right interior surface 442 of the right opposing side wall 440; and a right exterior surface 444 of the right opposing side wall 440; and a locking system, comprising; a releasable locking lip, comprising: a front releasable locking lip 512 extending inward from the front interior surface 412 of the front opposing end wall 410; a back releasable locking lip 522 extending inward from the back interior surface 422 of the back opposing end wall 420; a left releasable locking lip 532 extending inward from the left interior surface 432 of the left opposing side wall 430; and a right releasable locking lip 542 extending inward from the right interior surface 442 of the right opposing side wall 440; the releasable locking lip being aligned with a perimeter of the vent grill 600 when the locking, protective vent grill cover system 100 is in a locked position covering the vent grill, the locked position comprising: the front releasable locking lip 512 engaging and covering a front edge perimeter 612 of the vent grill; the back releasable locking lip 522 engaging and covering a back edge perimeter 622 of the vent grill 600; the left releasable locking lip 532 engaging and covering a left edge perimeter 632 of the vent grill 600; and the right releasable locking lip 542 engaging and covering a right edge perimeter 642 of the vent grill 600.

Some embodiments of the present technology include a locking, protective vent grill cover system 100 comprising: a protective top cover 200 configured to provide cushioning against external impact comprising a top cover perimeter, the top cover perimeter comprising: a front perimeter; a back perimeter; a left side perimeter; and a right side perimeter; an underside 300 opposite of the protective top cover 200 configured to lock to a vent grill; a front opposing end wall 410 extending below the front perimeter of the top cover perimeter, the front opposing end wall 410 comprising: a front interior surface 412 of the front opposing end wall 410; and a front exterior surface 414 of the front opposing end wall 410; a back opposing end wall 420 extending below the back perimeter of the top cover perimeter and opposing the front opposing end wall 410, the back opposing end wall 420 comprising: a back interior surface 422 of the back opposing end wall 420; and a back exterior surface 424 of the back opposing end wall 420; a left opposing side wall 430 extending below the left side perimeter of the top cover perimeter, the left opposing side wall 430 comprising: a left interior surface 432 of the left opposing side wall 430; and a left exterior surface 434 of the left opposing side wall 430; a right opposing side wall 440 extending below the right side perimeter of the top cover perimeter and opposing the left opposing side wall 430, the right opposing side wall 440 comprising: a right interior surface 442 of the right opposing side wall 440; and a right exterior surface 444 of the right opposing side wall 440; and a locking system, comprising; a releasable locking lip, comprising: a front releasable locking lip 512 extending inward from the front interior surface 412 of the front opposing end wall 410; a back releasable locking lip 522 extending inward from the back interior surface 422 of the back opposing end wall 420; a left releasable locking lip 532 extending inward from the left interior surface 432 of the left opposing side wall 430; and a right releasable locking lip 542 extending inward from the right interior surface 442 of the right opposing side wall 440; the releasable locking lip being aligned with a perimeter of the vent grill 600 when the locking, protective vent grill cover system 100 is in a locked position covering the vent grill, the locked position comprising: the front releasable locking lip 512 engaging and covering a front edge perimeter 612 of the vent grill; the back releasable locking lip 522 engaging and covering a back edge perimeter 622 of the vent grill 600; the left releasable locking lip 532 engaging and covering a left edge perimeter 632 of the vent grill 600; and the right releasable locking lip 542 engaging and covering a right edge perimeter 642 of the vent grill 600.

In some embodiments of the present technology the protective top cover 200 is a rectangular shape, a square shape, or a circle shape.

In some embodiments, the systems described herein relate to a locking, protective vent grill cover system 100 including: a protective top cover 200 configured to provide cushioning against external impact including a top cover perimeter, the top cover perimeter including: an underside 300 opposite of the protective top cover 200 configured to lock to a vent grill including a releasable locking lip; a locking system, including; the releasable locking lip being aligned with a perimeter of the vent grill when the locking, protective vent grill cover system 100 is in a locked position covering the vent grill, the locked position including: the releasable locking lip engaging and covering at least one edge of the vent grill.

In some embodiments, the systems described herein relate to a locking, protective vent grill cover system, wherein the protective top cover 200 is a rectangular shape, a square shape, or a circle shape.

While this technology is susceptible of embodiments in many different forms, there is shown in the drawings and has been described in detail several specific embodiments with the understanding that the present disclosure is to be considered as an exemplification of the principles of the technology and is not intended to limit the technology to the embodiments illustrated.

Although the terms first, second, left, right, front, back etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, for example, a left element, component, region, layer or section discussed below could be termed a right element, component, region, layer or section without departing from the teachings of the present disclosure. Thus, for another example, a front element, component, region, layer or section discussed below could be termed a back element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, elements, and/or components, but do not preclude the presence or addition of one or more other features, integers, steps, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing systems and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography and/or others.

Unless otherwise defined, all terms (comprising technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "above," "lower," "upper," "small," "large," "left," "right," "front," and "back" may be used herein to describe one element's relationship to another element as illustrated in the accompanying drawings. Such relative terms are intended to encompass different orientations of illustrated technologies in addition to the orientation depicted in the accompanying drawings. For example, if a device or system in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A locking, protective vent grill cover system comprising:

a protective top cover made of an elastomeric material and configured to provide cushioning against external impact, the protective top cover comprising a top cover rectangular perimeter, the top cover rectangular perimeter comprising:

a front rectangular perimeter;

a back rectangular perimeter;

a left side rectangular perimeter; and a right side rectangular perimeter;

an underside opposite of the protective top cover configured to lock to a vent grill;

a front opposing end wall made of the elastomeric material and extending continuously below the front rectangular perimeter of the top cover rectangular perimeter, the front opposing end wall comprising:

a front interior surface of the front opposing end wall; and a front exterior surface of the front opposing end wall;

a back opposing end wall made of the elastomeric material and extending continuously below the back rectangular perimeter of the top cover rectangular perimeter and opposing the front opposing end wall, the back opposing end wall comprising:

a back interior surface of the back opposing end wall; and a back exterior surface of the back opposing end wall;

a left opposing side wall made of the elastomeric material and extending continuously below the left side rectangular perimeter of the top cover rectangular perimeter, the left opposing side wall comprising:

a left interior surface of the left opposing side wall; and a left exterior surface of the left opposing side wall;

a right opposing side wall made of the elastomeric material and extending continuously below the right side rectangular perimeter of the top cover rectangular perimeter and opposing the left opposing side wall, the right opposing side wall comprising:

a right interior surface of the right opposing side wall; and a right exterior surface of the right opposing side wall; and a locking system, comprising;

an elastically releasable locking lip, comprising:

a front elastically releasable locking lip made of the elastomeric material and extending inward continuously from the front interior surface of the front opposing end wall;

a back elastically releasable locking lip made of the elastomeric material and extending inward continuously from the back interior surface of the back opposing end wall;

a left elastically releasable locking lip made of the elastomeric material and extending inward continuously from the left interior surface of the left opposing side wall;

a right elastically releasable locking lip made of the elastomeric material and extending inward continuously from the right interior surface of the right opposing side wall; and the elastically releasable locking lip being continuous along a perimeter formed by the front elastically releasable locking lip, the back elastically releasable locking lip, the left elastically releasable locking lip, and the right elastically releasable locking lip;

the releasable locking lip being aligned with a perimeter of the vent grill when the locking, protective vent grill cover system is in a locked position covering the vent grill, the locked position comprising:

the front elastically releasable locking lip engaging and covering a front edge perimeter of the vent grill;

the back elastically releasable locking lip engaging and covering a back edge perimeter of the vent grill;

the left elastically releasable locking lip engaging and covering a left edge perimeter of the vent grill; and the right elastically releasable locking lip engaging and covering a right edge perimeter of the vent grill.

2. The locking, protective vent grill cover system of claim 1, wherein the protective top cover further comprises apertures, the apertures being through the protective top cover and the underside allowing for airflow through a duct connected to the vent grill.

3. The locking, protective vent grill cover system of claim 2, wherein the apertures are a hexagonal shape.

4. The locking, protective vent grill cover system of claim 2, wherein the apertures comprise slits, the slits being aligned with vent slits of the vent grill allowing for airflow through the duct connected to the vent grill.

5. The locking, protective vent grill cover system of claim 2, wherein the apertures comprise circular holes, the circular holes having a diameter less that any opening on the vent grill thereby reducing airflow through the duct connected to the vent grill.

6. The locking, protective vent grill cover system of claim 1, wherein the protective top cover is solid with no apertures, the protective top cover thereby inhibiting airflow through a duct connected to the vent grill.

7. The locking, protective vent grill cover system of claim 1, wherein the elastically releasable locking lip extends a distance equal to a thickness of the protective top cover comprising:

the front elastically releasable locking lip extending inward from the front interior surface of the front opposing end wall the distance equal to the thickness of the protective top cover;

the back elastically releasable locking lip extending inward from the back interior surface of the back opposing end wall the distance equal to the thickness of the protective top cover;

the left elastically releasable locking lip extending inward from the left interior surface of the left opposing side wall the distance equal to the thickness of the protective top cover; and the right elastically releasable locking lip extending inward from the right interior surface of the right opposing side wall the distance equal to the thickness of the protective top cover.

8. The locking, protective vent grill cover system of claim 1, wherein the elastically releasable locking lip extends a distance greater than a thickness of the protective top cover comprising:

the front elastically releasable locking lip extending inward from the front interior surface of the front opposing end wall the distance greater than the thickness of the protective top cover;

the back elastically releasable locking lip extending inward from the back interior surface of the back opposing end wall the distance greater than the thickness of the protective top cover;

the left elastically releasable locking lip extending inward from the left interior surface of the left opposing side wall the distance greater than the thickness of the protective top cover; and the right elastically releasable locking lip extending inward from the right interior surface of the right opposing side wall the distance greater than the thickness of the protective top cover.

9. The locking, protective vent grill cover system of claim 1, wherein the elastically releasable locking lip extends a distance greater than an aperture distance, the aperture distance being a shortest distance of apertures in the protective top cover to the top cover rectangular perimeter comprising:

the front elastically releasable locking lip extending inward from the front interior surface of the front opposing end wall the distance greater than the aperture distance;

the back elastically releasable locking lip extending inward from the back interior surface of the back opposing end wall the distance greater than the aperture distance;

the left elastically releasable locking lip extending inward from the left interior surface of the left opposing side wall the distance greater than the aperture distance; and the right elastically releasable locking lip extending inward from the right interior surface of the right opposing side wall the distance greater than the aperture distance.

10. The locking, protective vent grill cover system of claim 1, wherein protective vent grill cover system is made of an elastomeric material comprising at least one of: silicone, rubber, polyurethane, cloth, foam, and acrylic.

11. The locking, protective vent grill cover system of claim 10, wherein the protective vent grill cover system is made of silicone and the protective top cover is five millimeters thick.

12. The locking, protective vent grill cover system of claim 1, wherein the protective top cover further comprises raised portions for padding, the raised portions extending upward from the protective top cover.

13. The locking, protective vent grill cover system of claim 1, wherein disengagement of the locking system, comprises:

release of the elastically releasable locking lip, comprising release of at least one of:

the front elastically releasable locking lip extending inward from the front interior surface of the front opposing end wall;

the back elastically releasable locking lip extending inward from the back interior surface of the back opposing end wall;

the left elastically releasable locking lip extending inward from the left interior surface of the left opposing side wall; and the right elastically releasable locking lip extending inward from the right interior surface of the right opposing side wall.

14. The locking, protective vent grill cover system of claim 1, wherein disengagement of the locking system, comprises:

release of the elastically releasable locking lip, comprising release of all of:

the front elastically releasable locking lip extending inward from the front interior surface of the front opposing end wall;

the back elastically releasable locking lip extending inward from the back interior surface of the back opposing end wall;

the left elastically releasable locking lip extending inward from the left interior surface of the left opposing side wall; and the right elastically releasable locking lip extending inward from the right interior surface of the right opposing side wall.

15. The locking, protective vent grill cover system of claim 1, wherein disengagement of the locking system, comprises:

release of the elastically releasable locking lip, comprising release of at least two of:

the front elastically releasable locking lip extending inward from the front interior surface of the front opposing end wall;

the back elastically releasable locking lip extending inward from the back interior surface of the back opposing end wall;

the left elastically releasable locking lip extending inward from the left interior surface of the left opposing side wall; and the right elastically releasable locking lip extending inward from the right interior surface of the right opposing side wall.

16. The locking, protective vent grill cover system of claim 1, wherein disengagement of the locking system, comprises:

release of the elastically releasable locking lip, comprising release of at least three of:

the front elastically releasable locking lip extending inward from the front interior surface of the front opposing end wall;

the back elastically releasable locking lip extending inward from the back interior surface of the back opposing end wall;

the left elastically releasable locking lip extending inward from the left interior surface of the left opposing side wall; and the right elastically releasable locking lip extending inward from the right interior surface of the right opposing side wall.

17. A locking, protective vent grill cover system comprising:

a protective top cover made of an elastomeric material and configured to provide cushioning against external impact, the protective top cover comprising a top cover rectangular perimeter, the top cover rectangular perimeter comprising:

hexagonal shaped apertures, the hexagonal shaped apertures being through the protective top cover allowing for airflow through a duct connected to a vent grill;

a front rectangular perimeter;

a back rectangular perimeter;

a left side rectangular perimeter; and a right side rectangular perimeter;

an underside opposite of the protective top cover configured to lock to a vent grill;

a front opposing end wall made of the elastomeric material and extending continuously below the front rectangular perimeter of the top cover rectangular perimeter, the front opposing end wall comprising:

a front interior surface of the front opposing end wall; and a front exterior surface of the front opposing end wall;

a back opposing end wall made of the elastomeric material and extending continuously below the back rectangular perimeter of the top cover rectangular perimeter and opposing the front opposing end wall, the back opposing end wall comprising:

a back interior surface of the back opposing end wall; and a back exterior surface of the back opposing end wall;

a left opposing side wall made of the elastomeric material and extending continuously below the left side rectangular perimeter of the top cover rectangular perimeter, the left opposing side wall comprising:

a left interior surface of the left opposing side wall; and a left exterior surface of the left opposing side wall;

a right opposing side wall made of the elastomeric material and extending continuously below the right side rectangular perimeter of the top cover rectangular perimeter and opposing the left opposing side wall, the right opposing side wall comprising:

a right interior surface of the right opposing side wall; and a right exterior surface of the right opposing side wall; and a locking system, comprising;

an elastically releasable locking lip, comprising:

a front elastically releasable locking lip made of the elastomeric material and extending continuously inward from the front interior surface of the front opposing end wall;

a back elastically releasable locking lip made of the elastomeric material and extending continuously inward from the back interior surface of the back opposing end wall;

a left elastically releasable locking lip made of the elastomeric material and extending continuously inward from the left interior surface of the left opposing side wall;

a right elastically releasable locking lip made of the elastomeric material and extending continuously inward from the right interior surface of the right opposing side wall; and the elastically releasable locking lip being continuous along a perimeter formed by the front elastically releasable locking lip, the back elastically releasable locking lip, the left elastically releasable locking lip, and the right elastically releasable locking lip;

the elastically releasable locking lip being aligned with a perimeter of the vent grill when the locking, protective vent grill cover system is in a locked position covering the vent grill, the locked position comprising:

the front elastically releasable locking lip engaging and covering a front edge perimeter of the vent grill;

the back elastically releasable locking lip engaging and covering a back edge perimeter of the vent grill;

the left elastically releasable locking lip engaging and covering a left edge perimeter of the vent grill; and the right elastically releasable locking lip engaging and covering a right edge perimeter of the vent grill.

18. A locking, protective vent grill cover system comprising:

a protective top cover made of an elastomeric material and configured to provide cushioning against external impact comprising a top cover perimeter, the top cover perimeter comprising:

an underside opposite of the protective top cover configured to lock to a vent grill comprising an elastically releasable locking lip; and a locking system, comprising;

the elastically releasable locking lip being continuous along a perimeter formed by one or more elastically releasable locking lip segments;

the elastically releasable locking lip being aligned with a perimeter of the vent grill when the locking, protective vent grill cover system is in a locked position covering the vent grill, the locked position comprising:

the elastically releasable locking lip engaging and covering at least one edge of the vent grill.

19. The locking, protective vent grill cover system of claim 18, wherein the protective top cover is a rectangular shape, a square shape, or a circle shape.

20. The locking, protective vent grill cover system of claim 18, wherein protective vent grill cover system is made of an elastomeric material comprising at least one of: silicone, rubber, polyurethane, cloth, foam, and acrylic.

* * * * *